US008961136B1

(12) United States Patent
Liang

(10) Patent No.: US 8,961,136 B1
(45) Date of Patent: Feb. 24, 2015

(54) TURBINE AIRFOIL WITH FILM COOLING HOLE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 605 days.

(21) Appl. No.: 13/397,012

(22) Filed: Feb. 15, 2012

(51) Int. Cl.
*F01D 5/08* (2006.01)
*F01D 5/18* (2006.01)

(52) U.S. Cl.
CPC ..... *F01D 5/186* (2013.01); *F01D 5/187* (2013.01)
USPC ..... 416/97 R; 416/95; 415/115

(58) Field of Classification Search
CPC ..... F01D 5/186; F01D 5/187; F01D 25/12; F05D 2260/202
USPC ..... 416/96 R, 97 R, 90 R, 96; 415/115
See application file for complete search history.

(56) References Cited

U.S. PATENT DOCUMENTS

| | | | | |
|---|---|---|---|---|
| 4,684,323 | A * | 8/1987 | Field | 416/97 R |
| 6,918,742 | B2 | 7/2005 | Liang | |
| 2010/0068032 | A1* | 3/2010 | Liang | 415/115 |
| 2011/0158820 | A1* | 6/2011 | Chamberlain et al. | 416/97 R |

* cited by examiner

*Primary Examiner* — Dwayne J White
*Assistant Examiner* — Adam W Brown
(74) *Attorney, Agent, or Firm* — John Ryznic

(57) ABSTRACT

A film cooling hole for an air cooled turbine airfoil, where the film cooling hole includes a first expansion section with expansion only on the downstream wall and a second expansion section with expansion on the downstream wall and the two side walls. No expansion is formed on the upstream walls on the first and second expansion sections.

5 Claims, 6 Drawing Sheets

TURBINE AIRFOIL WITH FILM COOLING HOLE

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to an air cooled turbine airfoil with film cooling holes.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Rotor blades and stator vanes within a turbine section of the gas turbine engine are typically cooled using a combination of convection cooling, impingement cooling and film cooling in order to control a metal temperature of the airfoil and prevent hot spots from occurring that can lead to erosion damage and therefore a short part life. This is especially critical in the industrial engines, since these engines must operate continuously for long periods of time.

Film cooling is used to discharge a blanket of film cooling air over the external surface of the airfoil and prevent the hot gas stream from contacting the airfoil external surface. Film cooling holes are mainly used on the airfoil leading edge region surface which is the surface of the airfoil exposed to the highest gas stream temperature. Large length to diameter film cooling holes are used in the leading edge region to provide both internal convection cooling to the airfoil wall and external film cooling for the external surface. For a laser or EDM (electric discharge machining) film cooling hole, a typical length to diameter ratio is less than 12 and the film cooling hole angle is usually no less than 20 degrees relative to the airfoil leading edge surface. FIG. 1 show a prior art film cooling hole with a large L/D ratio and is a straight hole with a constant diameter from an inlet end to an outlet end that provides no diffusion of the film cooling air prior to discharge.

FIG. 2 shows a prior art film cooling air hole with a constant diameter metering inlet section 11 and a diffusion section 12 that opens onto the airfoil surface. this film cooling hole is angled at 25 degrees to the airfoil surface with a 10 degree expansion on the downstream wall of the diffusion section 12. Both the film cooling holes in FIGS. 1 and 2 have an L/D ratio of around 14 and both film cooling holes have hole angles and L/D ratios that exceed current manufacturing capability. Because of the diffusion section in the FIG. 2 film cooling hole, a large film hole breakout is formed on the airfoil surface. U.S. Pat. No. 6,869,268 issued to Liang on Mar. 22, 2005 and entitled COMBUSTION TURBINE WITH AIRFOIL HAVING ENHANCED LEADING EDGE DIFFUSION HOLES AND RELATED METHODS discloses the FIG. 2 film cooling hole.

A further improvement of the film cooling holes is shown in FIGS. 3 and 4 in which the constant diameter metering section 21 discharges into a first diffusion section 22 and then a second diffusion section 23 that opens onto the airfoil surface. U.S. Pat. No. 4,653,983 issued to Vehr on Mar. 31, 1987 and entitled CROSS-FLOW FILM COOLING PASSAGES and U.S. Pat. No. 5,382,133 issued to Moore et al on Jan. 17, 1995 and entitled HIGH COVERAGE SHAPED DIFFUSER FILM HOLE FOR THIN WALLS discloses these types of double diffusion film cooling holes.

U.S. Pat. No. 4,684,323 issued to Field on Aug. 4, 1987 and entitled FILM COOLING PASSAGES WITH CURVED CORNERS and U.S. Pat. No. 6,183,199 issued to Beeck et al on Feb. 6, 2001 and entitled COOLING-AIR BORE discloses three dimension holes in an axial or small compound angle and a variety of expansion shapes that further enhances the film cooling capability.

A further improvement over the three-dimensional diffusion holes is disclosed in U.S. Pat. No. 6,918,742 issued to Liang on Jul. 19, 2005 and entitled COMBUSTION TURBINE WITH AIRFOIL HAVING MULTI-SECTION DIFFUSION COOLING HOLES AND METHODS OF MAKING SAME which discloses a multiple diffusion compounded film cooling holes having a constant diameter metering inlet section to provide cooling flow metering capability followed by a 3 to 5 degree expansion in the radial outward direction and a combination of 3 to 5 degree followed by a 10 degree multi-expansion in the downstream and radial inboard directions. There is no expansion for the film hole on the upstream side wall where the film cooling hole is in contact with the hot gas stream.

BRIEF SUMMARY OF THE INVENTION

A film cooling hole for an air cooled turbine airfoil in which the film cooling hole includes a metering inlet section followed by a first expansion section and a second expansion section. The first expansion section has expansion only on the downstream wall at 20 to 30 degrees. The second expansion section has a 20 to 30 degree expansion on the downstream wall as well as a 10 degree expansion on both side walls.

DETAILED DESCRIPTION OF THE INVENTION

Figure 2:
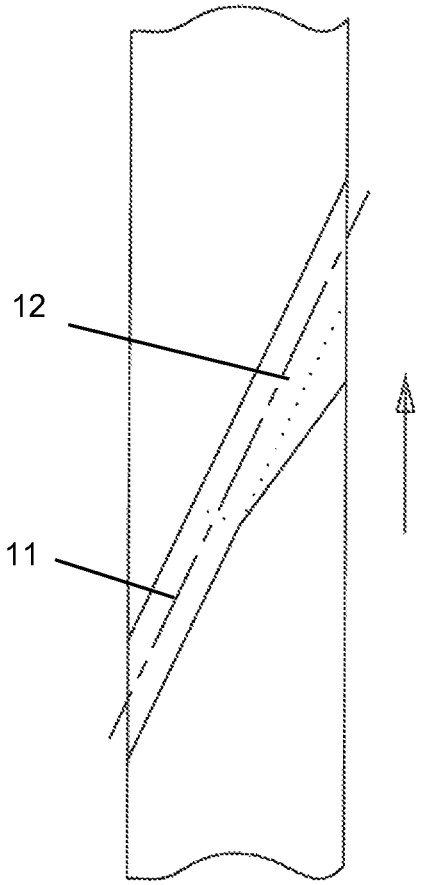
FIG 2 Prior Art
FIG. 2 shows a prior art film cooling hole with a diffusion section.
Figure 1:
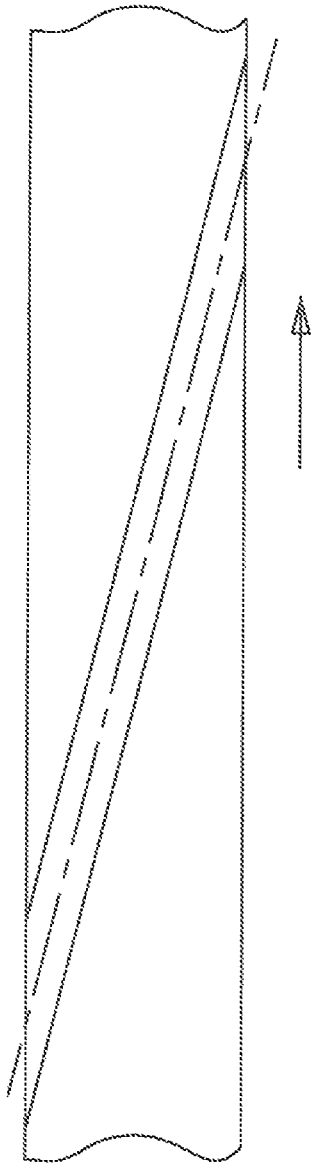
FIG 1 Prior Art
FIG. 1 shows a prior art straight film cooling hole.
Figure 3:
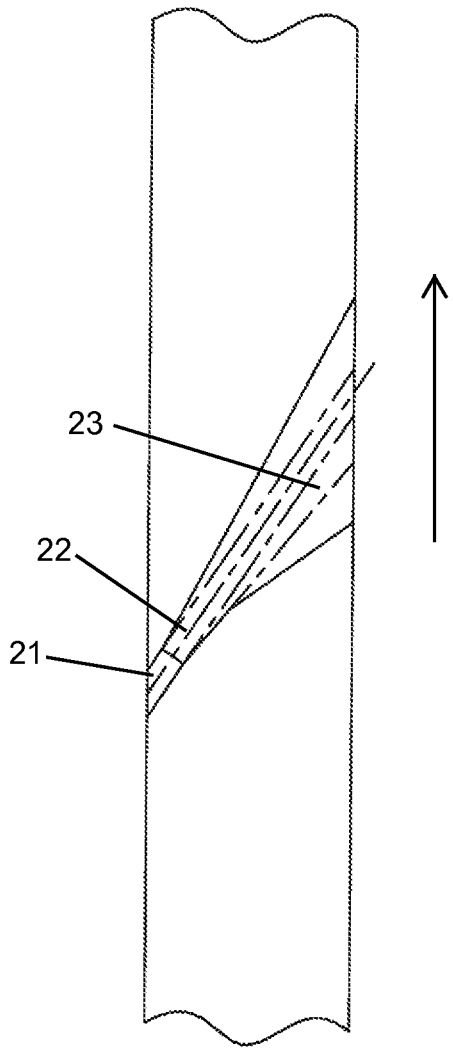
FIG 3 Prior Art
FIG. 3 shows a prior art film cooling hole with first and second diffusion sections.
Figure 4:
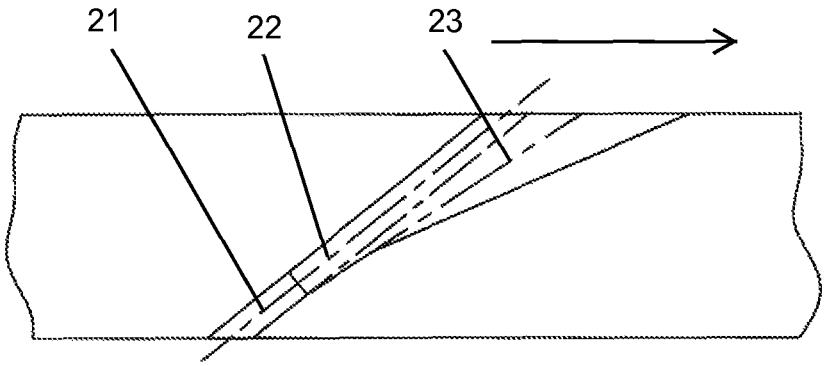
FIG 4 Prior Art
FIG. 4 shows a prior art film cooling hole with first and second diffusion sections having expansion on both the upstream and downstream walls.
Figure 5:
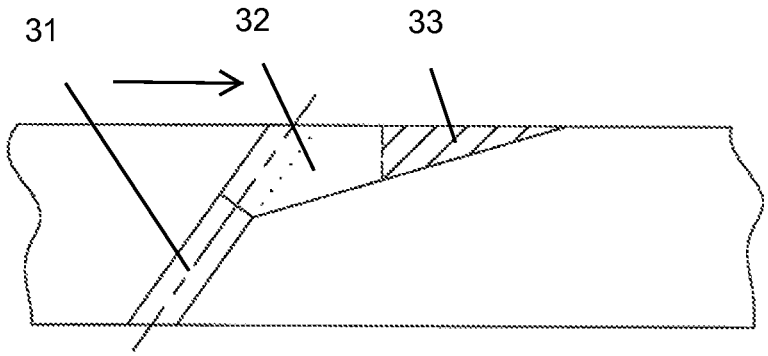
FIG. 5 shows a cross section side view of the film cooling hole of the present invention.
Figure 6:
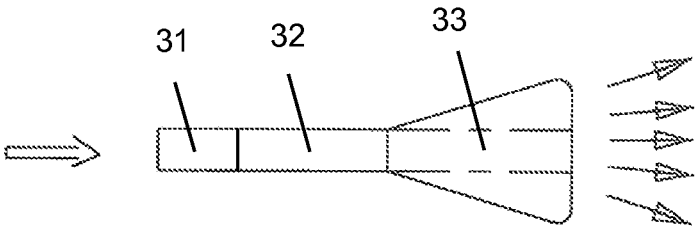
FIG. 6 shows a cross section top view of the film cooling hole of the present invention.

The present invention is a film cooling hole for an air cooled turbine airfoil such as a rotor blade or a stator vane. Turbine airfoil film cooling flow distribution and film cooling effectiveness level can be improved with the new, effective film cooling slot geometry into the current airfoil cooling designs. FIGS. 5 and 6 shows the film cooling hole design with downstream divergent surface. This unique "delayed" diffusion film cooling hole includes a constant diameter cross section cooling air feed holes 31 at the entrance region which provides cooling flow metering capability follow by a 1-D expansion 32 at the metering exit section. There is no expansion for the film hole on the up-stream sidewall as well as spanwise side walls where the film cooling hole is in contact with the hot gas at the forward end of the downstream divergent channel. At half way down, the divergent section 33 for the cooling channel is then expanded in the spanwise direction at 10 degree relative to the metering hole centerline. The metering length is about 2.5× of the cooling hole diameter and the streamwise divergent angle is about 20-30 degrees relative to the centerline of the metering hole. This streamwise divergent angle is much greater than the traditional 10 degrees divergent angle used in the current turbine blade cooling design.

FIG. 5 shows a cross section side view of the film cooling hole of the present invention with the constant diameter inlet metering section 31 followed by first expansion section 32 and then the second expansion section 33. The first expansion section 32 has only an expansion on the downstream wall with zero expansion on the upstream wall and the two side walls. The second expansion section 33 includes the same expansion amount on the downstream wall as the first expansion section 32, but also includes expansion on the two side walls as is seen in FIG. 6.

The key purpose for the use of the unique geometry in the downstream diffusion film cooling hole surface is to allow the cooling flow discharges from each individual metering hole injects into the downstream divergent channel and diffuses within the channel. This yields a good built-up of the coolant boundary layer within the airfoil surface and forms a "No Shear Mixing effect" to seal the airfoil from the hot gas molecules. This downstream divergent channel will prolong the cooling air within the channel; eject the film flow at much shallower angle, and yields higher film effectiveness at longer carry-over distance.

In operation cooling air is fed through the metering holes 31 and diffused into the first portion 32 of the downstream divergent channel and then further flowing into the rest of the downstream diffusion channel 33 prior exiting from the downstream film cooling channel 33. Majority of the cooling air is retained within the downstream cooling channel formed by the deep streamwise diffusion channel. Since at the downstream divergent cooling channel becomes shallower as the cooling flow along the cooling channel, a portion of the cooling air flow will start to exit from the cooling channel and spread out onto the airfoil hot surfaces.

Figure 7:
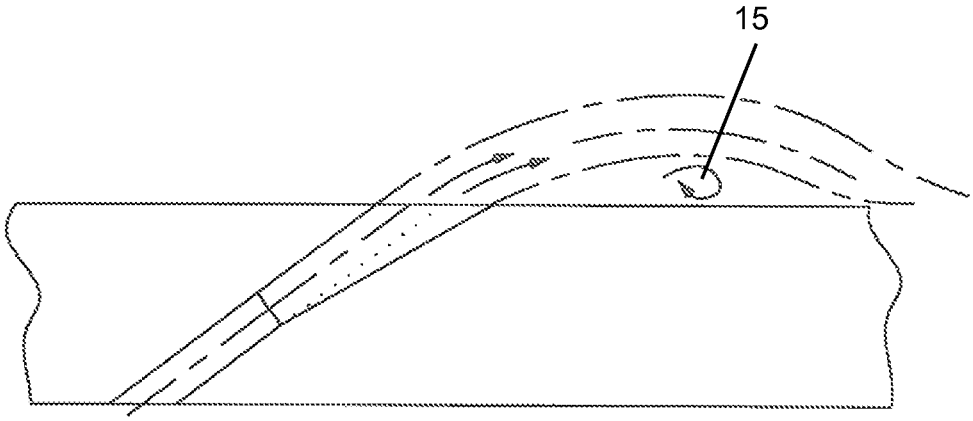
FIG 7 Prior Art
FIG. 7 shows a prior art film cooling hole and film injection with vortices that are formed above the airfoil surface downstream from the breakout hole.

In the normal film cooling hole design, the film flow is discharges from the hole and then penetrates into the main stream hot gas flow. Subsequently the film cooling air reattaches to the airfoil surface at approximately a distance of 2 times of the film slot diameter. Hot gas ingestion into the spacing below the film injection location and subsequently a pair of vortices 15 (see FIG. 7) is formed under the film ejection flow. Shearing mixing takes place between these pair of vortices and film cooling flow. As a result of this shear mixing, the film effectiveness is thus reduced.

Figure 8:
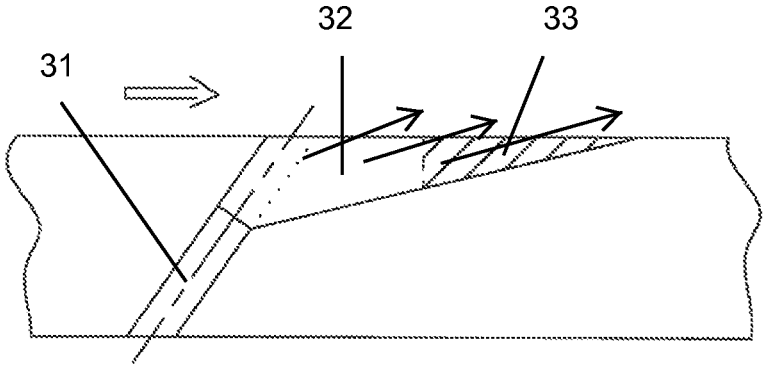
FIG. 8 shows a cross section side view of the film cooling hole of the present invention with the film ejection and the multiple diffusion downstream divergent surfaces.

However, for the current film cooling hole geometry with deep divergent surface arrangement and delayed spanwise expansion at the down stream diffusion channel, the film cooling air is retained within the cooling channel and extended further out without experiencing any shear mixing with the main stream hot gas flow. In addition, the film cooling flow is forced to eject film flow more closer toward the airfoil surface and thus minimize the vortices formation under the film stream at the injection location. Higher film effectiveness is generated by minimizing film layer shear mixing with the hot gas vortices and film cooling air. A potential good film layer can then be established onto the blade surface by this delayed downstream expansion geometry as represented in FIG. 8. This unique film cooling slot geometry yields a higher film effectiveness level.

I claim the following:

1. A film cooling hole for an air cooled turbine airfoil comprising:

a metering inlet section;

a first expansion section located downstream from the metering inlet section;

a second expansion section located downstream from the first expansion section;

the second expansion section opening onto a surface of the airfoil;

the first expansion section having zero expansion on an upstream wall and two side walls; and, the second expansion section having zero expansion on an upstream wall and positive expansion on two side walls.

2. The film cooling hole of claim 1, and further comprising:

the first and second expansion sections have the same expansion on the downstream walls.

3. The film cooling hole of claim 2, and further comprising:

the first and second expansion sections have a downstream wall expansion of 20 to 30 degrees.

4. The film cooling hole of claim 1, and further comprising:

the expansion of the two side walls in the second expansion section is around 10 degrees.

5. The film cooling hole of claim 1, and further comprising:

a length of the metering inlet section is around two and one half times the metering inlet section diameter.

* * * * *